US006509822B2

(12) United States Patent
Junjie et al.

(10) Patent No.: US 6,509,822 B2
(45) Date of Patent: Jan. 21, 2003

(54) STRUCTURE OF TRANSFORMER BOBBIN ASSEMBLY HAVING MULTIPLE STEP PIN ROWS

(75) Inventors: Zheng Junjie, Samutprakarn (TH); Didier Chaumet, Samutprakarn (TH)

(73) Assignees: Delta Electronics, Inc. (TW); Delta Electronics Public Ltd., Thailand ( * ) Notice: Subject to any disclaimer, the term of this patent is extended or adjusted under 35 U.S.C. 154(b) by 0 days.

(21) Appl. No.: 09/733,313

(22) Filed: Dec. 8, 2000

(65) Prior Publication Data

US 2002/0070833 A1 Jun. 13, 2002

(51) Int. Cl.[7] ..... H01F 27/30
(52) U.S. Cl. ..... 336/198; 336/198; 336/192
(58) Field of Search ..... 336/198, 192, 336/185, 182, 170, 208; 310/194

(56) References Cited

U.S. PATENT DOCUMENTS 4,661,792 A * 4/1987 Watkins ..... 336/65
4,890,085 A * 12/1989 Saito et al. ..... 336/192
5,696,477 A * 12/1997 Yamamori et al. ..... 336/192
6,072,380 A * 6/2000 Monroe ..... 336/198

* cited by examiner

*Primary Examiner*—Elvin Enad
*Assistant Examiner*—Jennifer A. Poker

(57) ABSTRACT

A structure of a transformer bobbin assembly is provided. The structure of the transformer bobbin assembly includes a cylinder, a magnetic core located within the cylinder, a primary winding coil and a secondary winding coil separately wound on the cylinder, a primary base and a secondary base connected to the cylinder, a plurality of primary pin leads disposed in a row and on the primary base, and a plurality of secondary pin leads disposed in multiple step rows and on the secondary base, wherein both ends of the secondary winding coil are connected to at least two of the secondary pin leads for providing a predetermined minimum creepage and clearance distance.

11 Claims, 4 Drawing Sheets

STRUCTURE OF TRANSFORMER BOBBIN ASSEMBLY HAVING MULTIPLE STEP PIN ROWS

FIELD OF THE INVENTION

The present invention relates to a structure of a transformer bobbin assembly, and more particularly to a structure of a transformer bobbin assembly having multiple step pin rows.

BACKGROUND OF THE INVENTION

The typical structure of a transformer assembly includes a magnetic core, a bobbin, a primary coil, a secondary coil and a plurality of pin leads. The primary coil and the secondary coil are separately wound on the bobbin and coupled electromagnetically through the magnetic core. The plurality pin leads are divided into two types, i.e. the primary pin leads and the secondary pin leads. The ends of the primary coil and the secondary coil are usually soldered onto the primary pin leads and the secondary pin leads, respectively.

FIG. 1 shows a perspective view of a traditional transformer bobbin. This bobbin 1 includes a cylinder 10, a primary base 11, a secondary base 12, a plurality of primary pin leads 111 disposed in the primary base 11 and a plurality of secondary pin leads 112 disposed in the secondary base 12. For safety regulations, the necessary creepage and clearance distances are always taken into consideration in order to make sure the primary winding coil and the secondary winding coil are not shorted. The requirement of creepage and clearance was met by adding some insulation tapes. The term "creepage" indicates the minimum distance along a surface of insulation between the primary winding coil and the secondary winding coil. The term "clearance" indicates the minimum distance between the primary winding coil and the secondary winding coil through air. Referring to FIG. 2, three layers of insulation tapes are applied for isolation and insulation. The transformer bobbin 1 further includes a primary winding coil 21, a secondary winding coil 22 and a magnetic core (not shown) located within the cylinder 10. The secondary winding coil 22 is wrapped by a first insulation tape 31 and then isolated by a second insulation tape 32. The primary winding coil 21 is then wound on the bobbin 1 over the second insulation tape 32 and wrapped with a third insulation tape 33. The third insulation tape 33 is also called the marginal tape, which is needed for isolation among the primary pin leads 111, the secondary pin leads 122, the primary winding coil 21 and the secondary winding coil 22. Generally, a tube (not shown) is used to cover the end of the primary coil 21 and the end of the secondary coil 22 for isolation with the magnetic core. It is apparent that the process for manufacturing such transformer is very labor-intensive and complicated. Moreover, the winding window is limited since the three insulation layers 31, 32 and 33 occupy some space. The structure of such transformer assembly results in an increasing inductance leakage due to the addition of the three insulation layers 31, 32 and 33; thus, the electric performance is decreased.

Therefore, the present invention provides an improved structure of a transformer bobbin assembly for overcoming the problems described above.

SUMMARY OF THE INVENTION

It is an object of the present invention to provide a structure of a transformer bobbin having multiple step pin rows for deleting the marginal tape, the insulation tape and the tube which are necessary for the traditional transformer.

In accordance with one aspect of the present invention, the structure of the transformer bobbin could meet the minimum creepage and clearance distance requirements. The transformer bobbin includes a cylinder, a primary base and a secondary base connected to the cylinder, a plurality of primary pin leads disposed in a row and on the primary base, a plurality of secondary pin leads disposed in multiple step rows and on the secondary base.

In accordance with another aspect of the present invention, the secondary pin leads are disposed in two step rows, i.e. the first step row and the second step row. Each of the first step row pin leads is used for supporting the secondary base. The secondary pin leads in the first step row can be kicked out, and at least two secondary pin leads are disposed in the second step row. Certainly, the secondary base can further include at least two cavities.

It is another object of the present invention to provide a transformer bobbin. The transformer bobbin includes a cylinder, a primary base and a secondary base connected to the cylinder, a plurality of primary pin leads disposed in multiple step rows and on the primary base, a plurality of secondary pin leads disposed in a row and on the secondary base.

It is another object of the present invention to provide a transformer bobbin assembly having multiple step pin rows for deleting the marginal tape, the insulation tape and the tube which are necessary for the traditional transformer.

The transformer bobbin assembly according to the present invention includes a cylinder, a magnetic core located within the cylinder, a primary winding coil and a secondary winding coil separately wound on the cylinder, a primary base and a secondary base connected to the cylinder, a plurality of primary pin leads disposed in a row and on the primary base, a plurality of secondary pin leads disposed in multiple step rows and on the secondary base, wherein both ends of the secondary winding coil are connected to at least two of the secondary pin leads for providing a predetermined minimum creepage and clearance distance, and a core shield placed over the ends of the cylinder for isolation among the magnetic core, the primary winding coil and the secondary winding coil.

Preferably, the multiple step rows includes a first step row and a second step row. Each of the secondary pin leads disposed in the first step row is used for supporting the secondary base. Preferably, at least two of the secondary pin leads are disposed in the second step row.

Certainly, the secondary base can further include at least two cavities for facilitating winding the both end of the secondary winding coil onto the two secondary pin leads in the second step row therethrough.

It is another object of the present invention to provide a transformer bobbin assembly.

The transformer bobbin assembly according to the present invention includes a cylinder, a magnetic core located within the cylinder, a primary winding coil and a secondary winding coil separately wound on the cylinder, a primary base and a secondary base connected to the cylinder, a plurality of primary pin leads disposed in multiple step rows and on the primary base wherein both ends of the primary winding coil are connected to at least two of the primary pin leads for providing a predetermined minimum creepage and clearance distance, a plurality of secondary pin leads disposed in a row and on the secondary base, and a core shield placed over the ends of the cylinder for isolation among the magnetic core, the primary winding coil and the secondary winding coil.

The transformer bobbin assembly according to the present invention has the advantages of less producing cost, less space occupied, simpler manufacturing process, easier winding and less leakage inductance.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
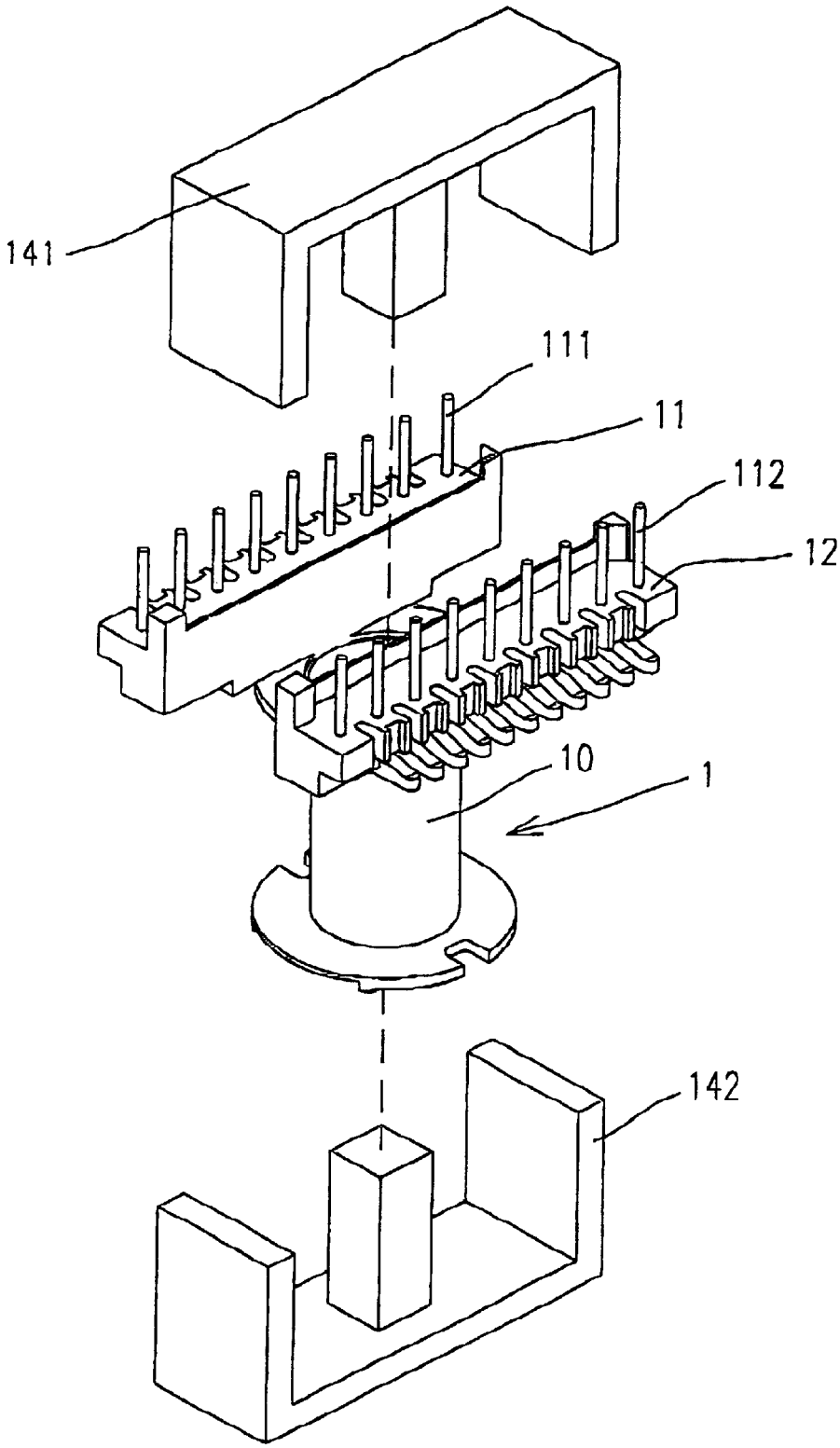
Fig. 1(PRIOR ART)
FIG. 1 is a perspective view of a transformer bobbin according to prior art.
Figure 2:
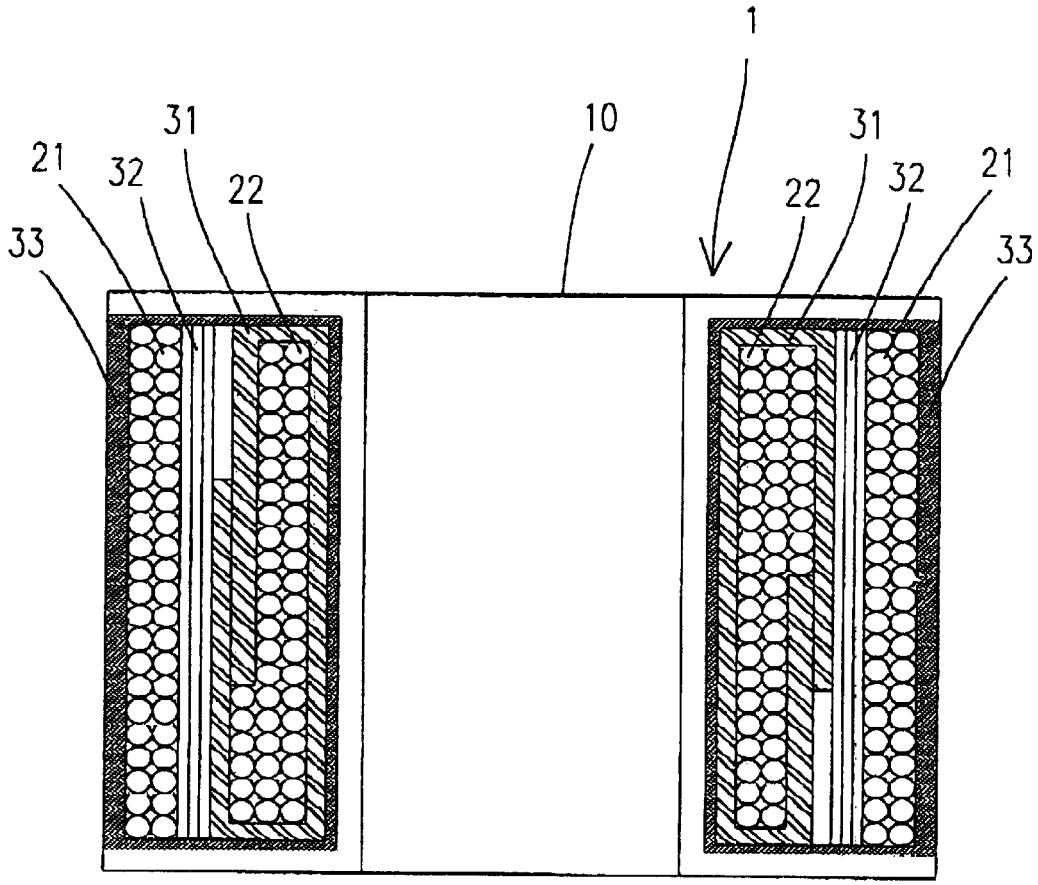
Fig. 2(PRIOR ART)
FIG. 2 is a schematic sectional view of a traditional transformer bobbin wound by coils and insulation tapes.
Figure 3:
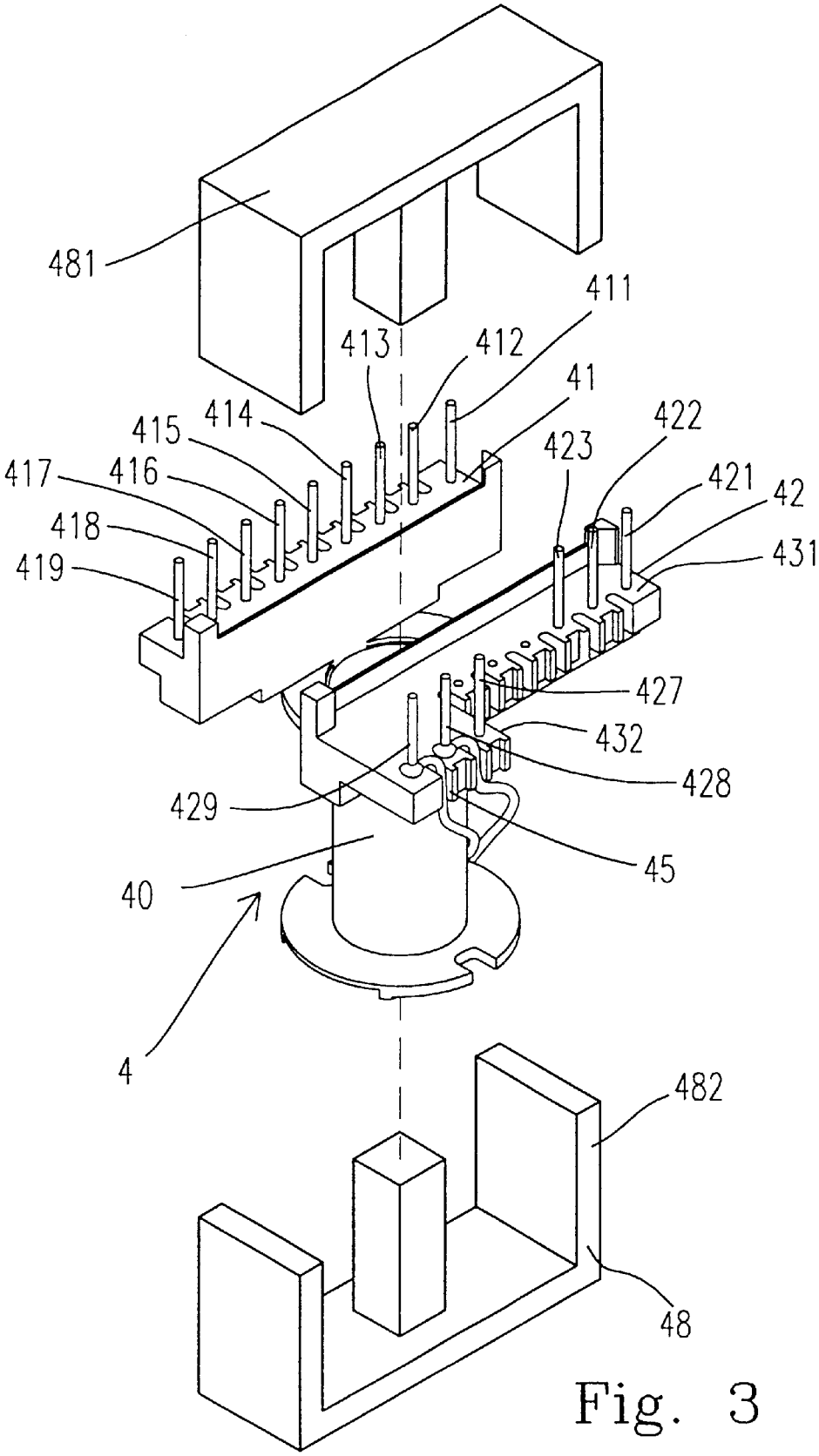
FIG. 3 is a perspective view of a transformer bobbin according to the first preferred embodiment of the present invention.

Referring to FIG. 3, the bobbin 4 for the first preferred embodiment of the present invention includes a cylinder 40, a primary base 41 and a secondary base 42 connected to the cylinder 40. Nine primary pin leads 411 to 419 are disposed in a row and on the first base 41. The secondary pin leads are disposed in two step rows and on the secondary base 42. In this embodiment, there are three secondary pin leads 421, 422 and 423 on the first step row 431, which are not soldered and principally used to support the secondary base 42 for PCB layout; and there are three secondary pin leads 427, 428 and 429 on the second step row 432, which provides a predetermined minimum creepage and clearance distance. The cylinder 40 of the bobbin is wound by a secondary winding coil (not shown) and the both ends of the secondary winding coil are soldered onto the two secondary lead pins 428, 429 in the second step row 432 (these two secondary pin leads 428 and 429 are hereinafter designated as "the secondary soldered pin leads", unless otherwise specified). However, the secondary pin leads except for these two secondary soldered pin leads could be kicked out or be used for supporting the primary base 41 or the secondary base 42. Subsequently, a primary winding coil (not shown) is wound over the secondary winding coil and the both ends of the primary winding coil (not shown) are soldered to the primary pin leads 411 to 419. The cavity 45 in the secondary base 42 is used for facilitate increasing strength of the secondary base 42 and easily being connected with the secondary soldered pin leads 428 and 429 therethrough.

Certainly, a core shield 48 composed of two insulating material 481, 482 can be placed over the ends of the cylinder 40 for isolation among the magnetic core, the primary winding coil and the secondary winding coil.

Certainly, the secondary soldered pin lead can be at any position of the second step row 432 and may be more than two pin leads, i.e. the soldered pins could be the pin leads 427/428, 427/429, 428/429 or 427/428/429. The pin leads except for the secondary soldered pin leads can be kicked out or left. The left pin leads are used for support the bobbin. More than two pin rows are also suitable for manufacturing the transformer bobbin according to the present invention only if the minimum creepage and clearance distance is achieved. The creepage and clearance distance of the final transformer needs to be measured.

Figure 4:
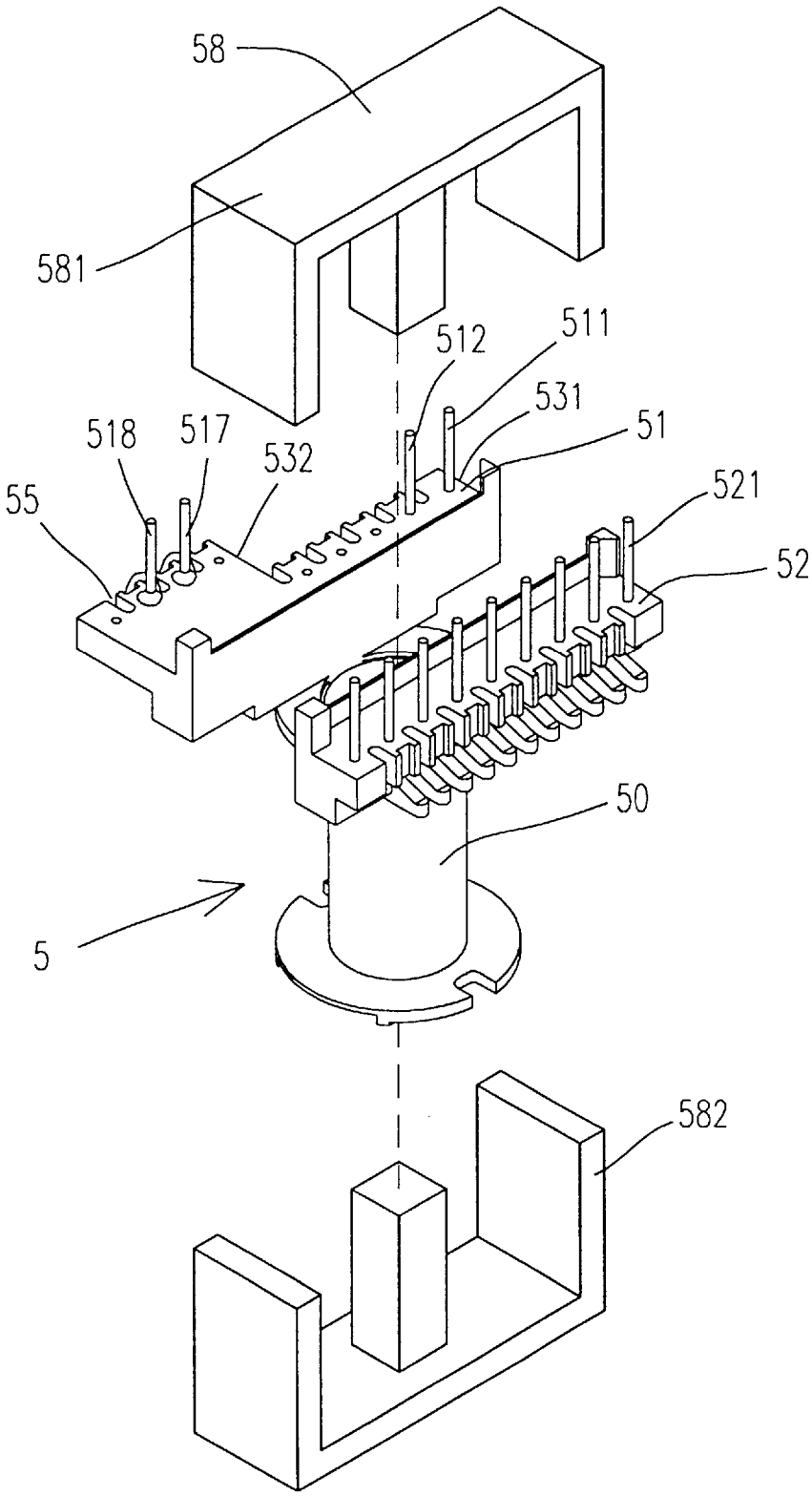
FIG. 4 is a perspective view of a transformer bobbin according to the second preferred embodiment of the present invention.

Referring to FIG. 4, the bobbin 5 for the first preferred embodiment of the present invention includes a cylinder 50, a primary base 51 and a secondary base 52 connected to the cylinder 50. Nine primary pin leads 521 are disposed in a row and on the second base 52. The primary pin leads are disposed in two step rows and on the primary base 51. In this embodiment, there are two primary pin leads 511 and 512 on the first step row 531, which are not soldered and principally used to support the primary base 51 for PCB layout; and there are two primary pin leads 517 and 518 on the second step row 532, which provides a predetermined minimum creepage and clearance distance. The cylinder 50 of the bobbin 5 is wound by a primary winding coil (not shown) and the both ends of the primary winding coil are soldered to the two primary lead pins 517 and 518 in the second step row 532 (these two primary pin leads 517 and 518 are hereinafter designated as "the primary soldered pin leads", unless otherwise specified). However, the primary pin leads except for these two primary soldered pin leads could be kicked out or be used for supporting the primary base 51 or the secondary base 52. Subsequently, a secondary winding coil (not shown) is wound over the primary winding coil and the both ends of the secondary winding coil (not shown) are soldered to the nine secondary pin leads 521. On the primary base 51, there are at least two cavities which are used for increasing the strength of the primary base 51 by connecting the primary winding coil ends to the primary pin leads 517 and 518 through the cavities 55.

Certainly, a core shield 58 composed of two insulating material 581, 582 can be placed over the ends of the cylinder 50 for isolation among the magnetic core, the primary winding coil and the secondary winding coil.

Certainly, the winding coils used in the present invention can be the Tex-E wire coated with a insulated material to meet the requirement of double insulation.

As will be apparent from the above description according to the present invention, the improved structure of the transformer bobbin could effectively meets the requirement of safety. The marginal tape, the insulation tapes and the tube can be omitted according to the present invention; thus, the magnetic core can be selected with smaller size, the cost is lowered, the manufacturing process is simpler and the leakage inductance will be shortened.

While the invention has been described in terms of what are presently considered to be the most practical and preferred embodiments, it is to be understood that the invention needs not be limited to the disclosed cmbodiment. On the contrary, it is intended to cover various modifications and similar arrangements included within the spirit and scope of the appended claims which are to be accorded with the broadest interpretation so as to encompass all such modifications and similar structure.

What is claimed is:

1. A structure of a transformer bobbin having multiple step pin rows, comprising:

a cylinder;

a primary base and a secondary base connected to said cylinder;

a plurality of primary pin leads disposed in a row and on said primary base; and a plurality of secondary pin leads disposed in multiple step rows and on said secondary base.

2. The structure according to claim 1, wherein said multiple step rows comprising a first step row and a second step row.

3. The structure according to claim 2, wherein each of said secondary pin leads disposed in said first step row is used for supporting said secondary base.

4. The structure according to claim 2, wherein said at least two of said secondary pin leads are disposed in said second step row.

5. A structure of a transformer bobbin having multiple step pin rows, comprising:

a cylinder;

a primary base and a secondary base connected to said cylinder;

a plurality of primary pin leads disposed in multiple step rows and on said primary base; and a plurality of secondary pin leads disposed in a row and on said secondary base.

6. A transformer bobbin assembly having multiple step row pin leads, comprising:

a cylinder;

a magnetic core located within said cylinder;

a primary winding coil and a secondary winding coil separately wound on said cylinder;

a primary base and a secondary base connected to said cylinder;

a plurality of primary pin leads disposed in a row and on said primary base; and a plurality of secondary pin leads disposed in multiple step rows and on said secondary base, wherein both ends of said secondary winding coil are connected to at least two of said secondary pin leads for providing a predetermined minimum creepage and clearance distance.

7. The transformer bobbin assembly according to claim 6, further comprising a core shield placed over the ends of said cylinder for isolation among said magnetic core, said primary winding coil and said secondary winding coil.

8. The transformer bobbin assembly according to claim 6, wherein said multiple step rows comprising a first step row and a second step row.

9. The transformer bobbin assembly according to claim 8, wherein each of said secondary pin leads in said first step row is used for supporting said secondary base.

10. The transformer bobbin assembly according to claim 8, wherein said at least two of said secondary pin leads are disposed in the second step row.

11. A transformer bobbin assembly having multiple step row pin leads, comprising:

a cylinder;

a magnetic core located within said cylinder;

a primary winding coil and a secondary winding coil separately wound on said cylinder;

a primary base and a secondary base connected to said cylinder;

a plurality of primary pin leads disposed in multiple step rows and on said primary base wherein both ends of said primary winding coil are connected to at least two of said primary pin leads for providing a predetermined minimum creepage and clearance distance; and a plurality of secondary pin leads disposed in a row and on said secondary base.

* * * * *